US006149496A

United States Patent [19]

Fildan

[11] Patent Number: 6,149,496

[45] Date of Patent: Nov. 21, 2000

[54] HIDDEN FRONT-CLOSURE BRASSIERE

[76] Inventor: Gerhard Fildan, Wohnpark Alte Erlaa, Anton Baumgartner Str. 44, C 4 17 01, A-1232 Vienna, Austria

[21] Appl. No.: 09/363,058

[22] Filed: Jul. 29, 1999

[51] Int. Cl.[7] ..... A41C 3/02

[52] U.S. Cl. ..... 450/58; 450/1; 450/695; 450/694

[58] Field of Search ..... 450/58, 1, 28, 450/33, 82, 9, 15, 17, 26, 86; 24/694, 695

[56] References Cited

U.S. PATENT DOCUMENTS

| | | | |
|---|---|---|---|
| D. 274,862 | 7/1984 | Fildan | D11/208 |
| 1,851,730 | 3/1932 | Rutherford | 24/695 |
| 2,346,887 | 4/1944 | Winkler | 24/695 |
| 2,765,471 | 10/1956 | Cousins | 24/695 |
| 3,445,901 | 5/1969 | Kamper | 24/695 |
| 3,837,049 | 9/1974 | Corrado | 450/82 |
| 4,204,300 | 5/1980 | Fildan | 24/583 |
| 4,998,330 | 3/1991 | D'Amore, Jr. | 24/700 |

*Primary Examiner*—Gloria M. Hale
*Attorney, Agent, or Firm*—Herbert Dubno

[57] ABSTRACT

A concealed front closure brassiere in which the closure has two closure members one of which is formed with the tongue while the other is formed with an eye in which the tongue is engaged with a snap fit. The closure members having sewing flanges which are coplanar and through which the flaps are stitched to the closure member so that their edges abut in the closed state of the closure. When the tongue is locked into the eye, inner surfaces of the eye and the tongue are flush with one another on the common plane of the brassiere.

20 Claims, 5 Drawing Sheets

9
e
f
34
36
37
38
39
42
43
44
45
46
47
35

HIDDEN FRONT-CLOSURE BRASSIERE

FIELD OF THE INVENTION

The present invention relates to a brassiere having a front closure assembly which is concealed in use. More particularly this invention relates to such a front closure which is simple to engage and disengage, which can be mounted on the brassiere simply and with ease, which does not irritate the wearer and which is concealed in use.

BACKGROUND OF THE INVENTION

Front closure brassieres are used in maternity applications to facilitate access to the breast and in nonmaternity applications because a front closure can be more easily manipulated by the wearer and thus can facilitate putting on and taking off the brassiere.

Such closures may have hook and eye formations, pin and groove configurations and a variety of other constructions to enable generally a male member to fit into a female member and lock in place until disengagement is intended.

By and large front closures hitherto in use have been difficult to apply to the portion of the brassiere between the cups, have frequently been of configurations which cause irritation to the wearer and are difficult to manipulate, i.e. to engage and disengage.

OBJECTS OF THE INVENTION

It is the principal object of the present invention to provide an improved brassiere having a front closure whereby the drawbacks enumerated above are obviated.

Another object of the invention is to provide a new front closure assembly for such a brassiere in which the closure itself is easy to mount on the brassiere, is simple to engage and disengage, and is free from projecting parts which may cause irritation to the wearer.

Another object of the invention is to provide a front closure for use in such an assembly.

SUMMARY OF THE INVENTION

These objects and others which will become apparent hereinafter are attained, in accordance with the invention, in a front closure assembly for a brassiere which comprises:

- a pair of fabric flaps extending toward one another from respective cups of a brassiere at a front thereof, the flaps having juxtaposed edges; and
- a hidden closure interconnecting the flaps and concealed from view in a connected state of the closure, the closure comprising:
  - a first closure member formed with a body, a tongue projecting from the body and a sewing flange projecting from the body in a direction opposite the tongue, and
  - a second closure member formed with a body, an eye formed on the body and dimensioned to receive the tongue, and a sewing flange projecting from the body in a direction opposite the eye,
  - the sewing flanges being flush with one another and lying in a common plane at one side of the closure in a closed state thereof,
  - the flaps being stitched to the sewing flanges so that the edges abut in the closed state of the closure,
  - the tongue being received in the eye so that surfaces of the eye and the tongue are flush with one another in a common plane on another side of the closure opposite the one side.

The tongue preferably engages with a snap fit in the eye and advantageously the tongue and eye are of rectangular, preferably square outline.

The sewing flanges can have thicknesses which are one-third to one-quarter of the overall thickness of the respective closure member and the body of the second closure member can have a portion overlapped by the eye and the tongue can engage over this portion in the closed state of the closure. The sewing flanges can be nonperforated or can be perforated to facilitate stitching therethrough.

The sewing flanges can have widths of about one-half to one-third of the overall width of the respective closure member. Fabric tabs can extend on the inside of the brassiere and can be stitched onto the sewing flange and through such tabs, the sewing flange and the respective flap.

On each of the closure members, a step may be provided on the inside to receive the respective tab.

The outside surface of the closure members are flush with one another and there respective flaps adjoin in the closed position of the closure to fully conceal the closure in use.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
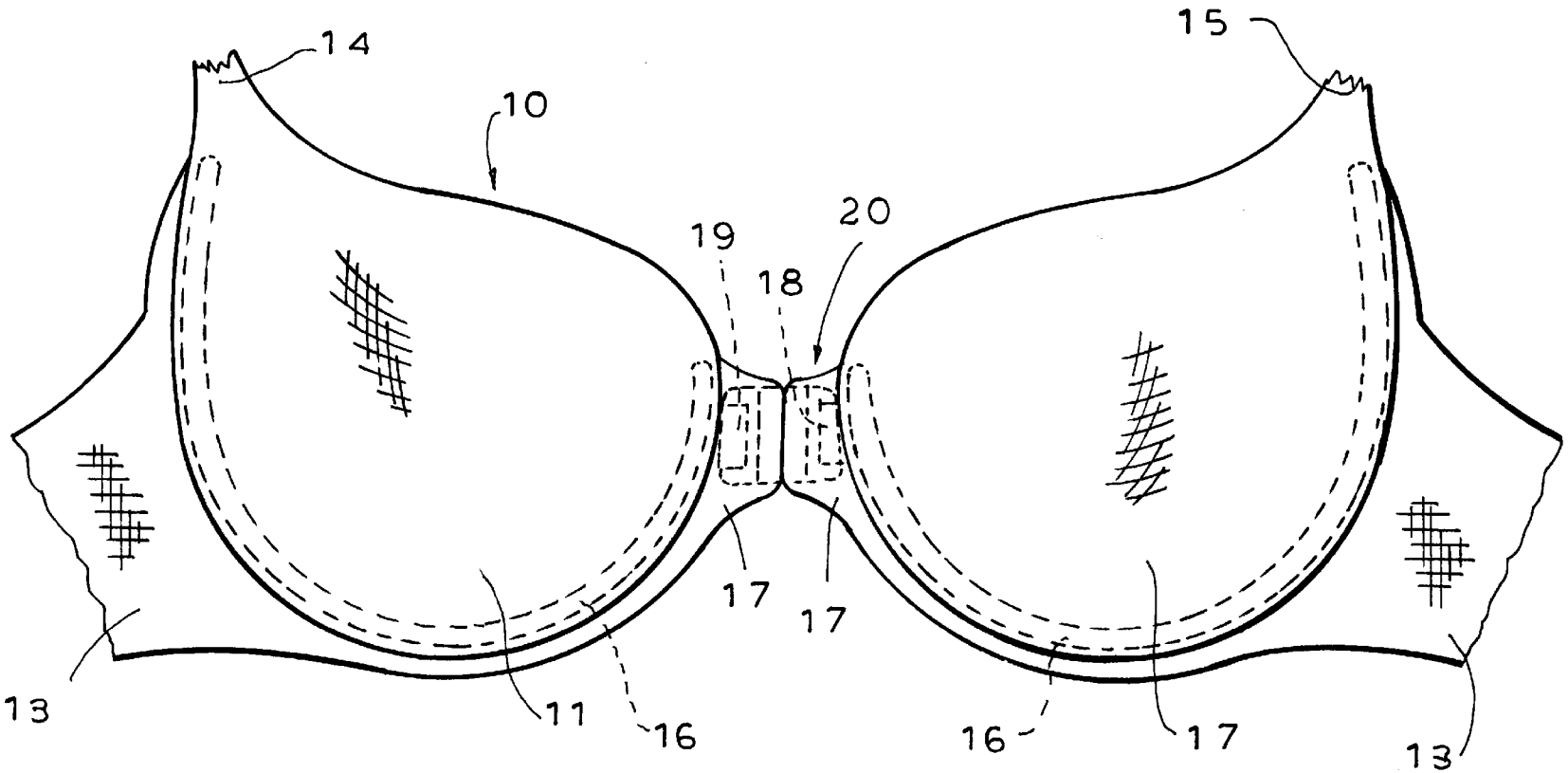
FIG. 1 is a front view of a brassiere having the concealed closure of the present invention.
Figure 2:
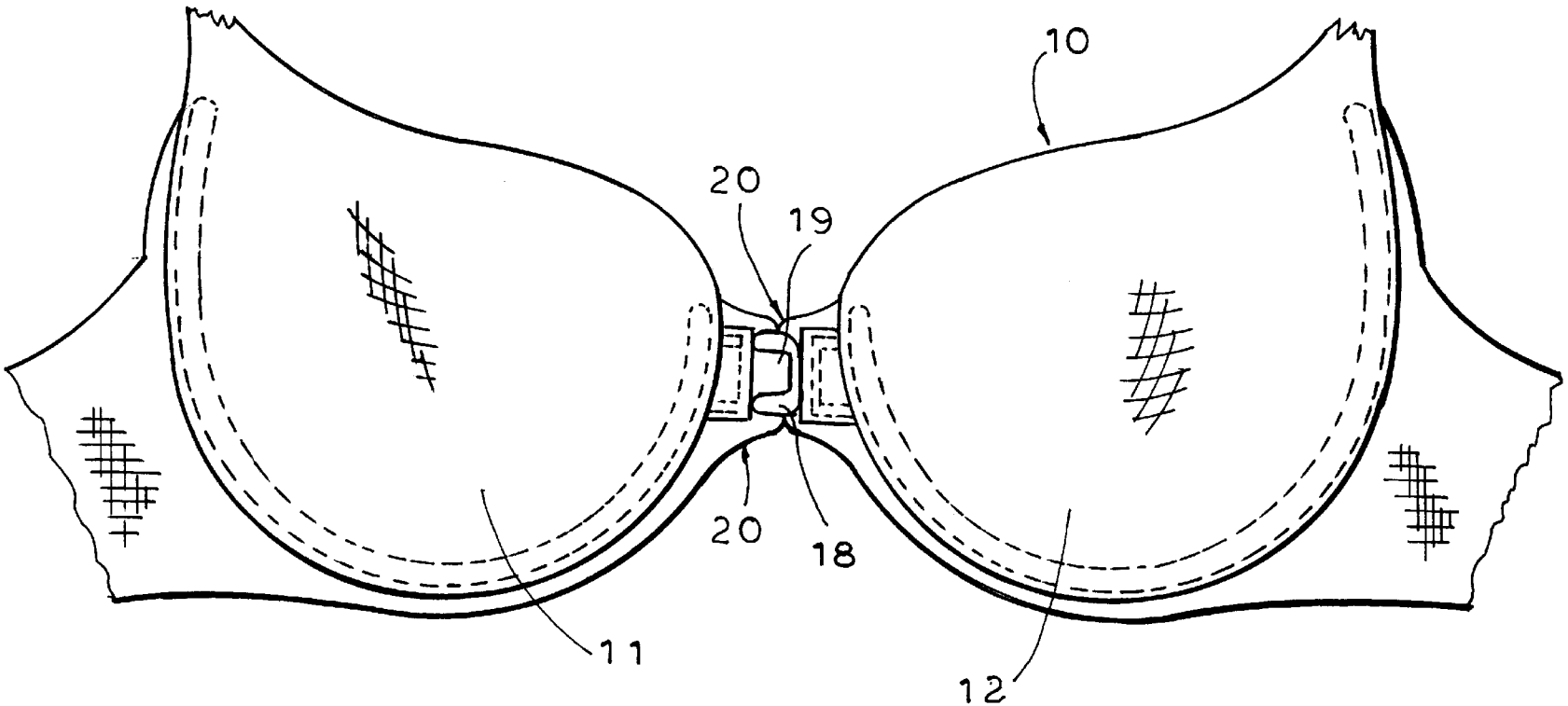
FIG. 2 is a rear view of the front of the brassiere, i.e. the brassiere from the inside, showing the region in which the front closure is mounted.

The brassiere 10 shown in FIGS. 1 and 2 comprises a pair of cups 11 and 12 connected to a strap 13 which rings around the back of the wearer and has been broken away in FIGS. 1 and 2. In addition shoulder straps 14 and 15 are provided. These also having been broken away in FIGS. 1 and 2.

As can be seen from these figures, the cups may be supported in part by wires or stays 16 which are received in tubular pockets formed in the fabric below the respective cups. Each of the cups has a flap 17 which is stitched to a female closure member 18 and a male closure member 19 forming a respective closure 20 which is concealed when the closure members are engaged with one another as is the case in FIG. 1. From FIG. 1, it will be apparent that the flaps 17 abut one another when the closure members are engaged to prevent the closure member from being seen.

Figure 3:
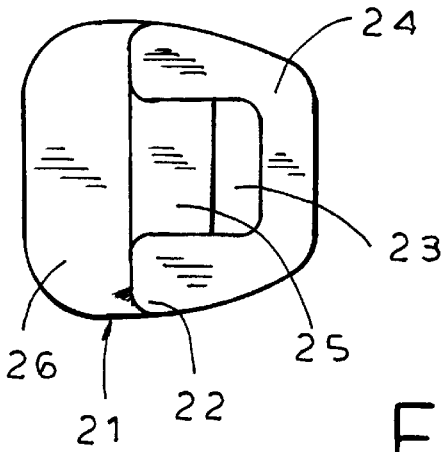
FIG. 3 is a front view of the female closure member of such a closure.
Figure 4:
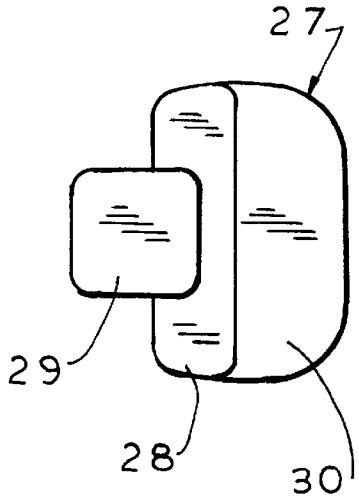
FIG. 4 is a view similar to FIG. 3 of the male closure member.

A female closure member 21 has been shown in FIG. 3 and can be substituted for the female closure member 12 of FIGS. 1 and 2. This closure member comprises a body 22 formed with an eye 23 defined by a frame 24 overlapping a ledge 25. From this body, a sewing flange 26 extends in a direction opposite from the frame 24.

Figure 5:
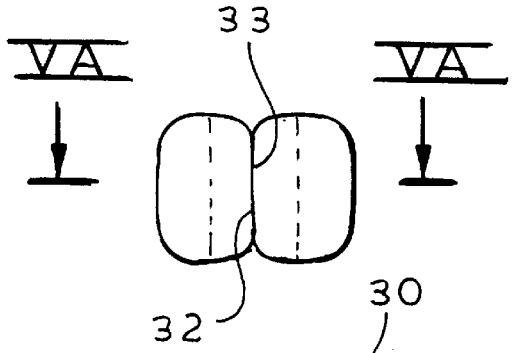
FIG. 5 is a front view of the assembled closure in its engaged position.
Figure 5A:
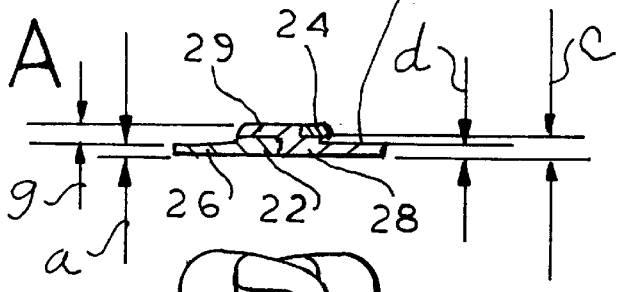
FIG. 5*a* is a cross sectional view taken along the view V—V of FIG. 5.

As can be seen from FIG. 5*a*, the thickness of the sewing flange can be substantially less than the thickness of the body 22 and the overall thickness of the closure member. Indeed, the thickness d of the sewing flange 26 can be one-third to one-quarter of the overall thickness b of the member and in an advantageous embodiment can be 0.7 mm while the overall thickness b is 2.6 mm.

The male member 27 has a body 28 from which a square tongue extends in one direction while a sewing flange 30 extends in the opposite direction. Here the body has a thickness c which is substantially greater than the thickness d of the sewing flange 30 and the sewing flange d may be one-third to one-quarter of the overall thickness b.

As can be seen from FIG. 5a, when the tongue 29 snaps into the eye 23, which is also of a square configuration, the tongue overlies the ledge 25 and the frame 24 and tongue 29 are flush with one another on the inside of the brassiere while the sewing flanges 26 and 30 and the bodies 22 and 28 lie in a common plane and are flush with one another at the front side so that the edges 32 and 33 of the bodies 28 and 22 abut against one another. To open the closure, one of the members is swung toward the front relative to the other and the tongue is withdrawn.

Figure 6:
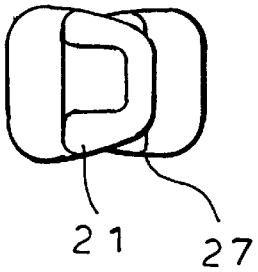
FIG. 6 is a rear view thereof.
Figures 7, 8, 9, 10:
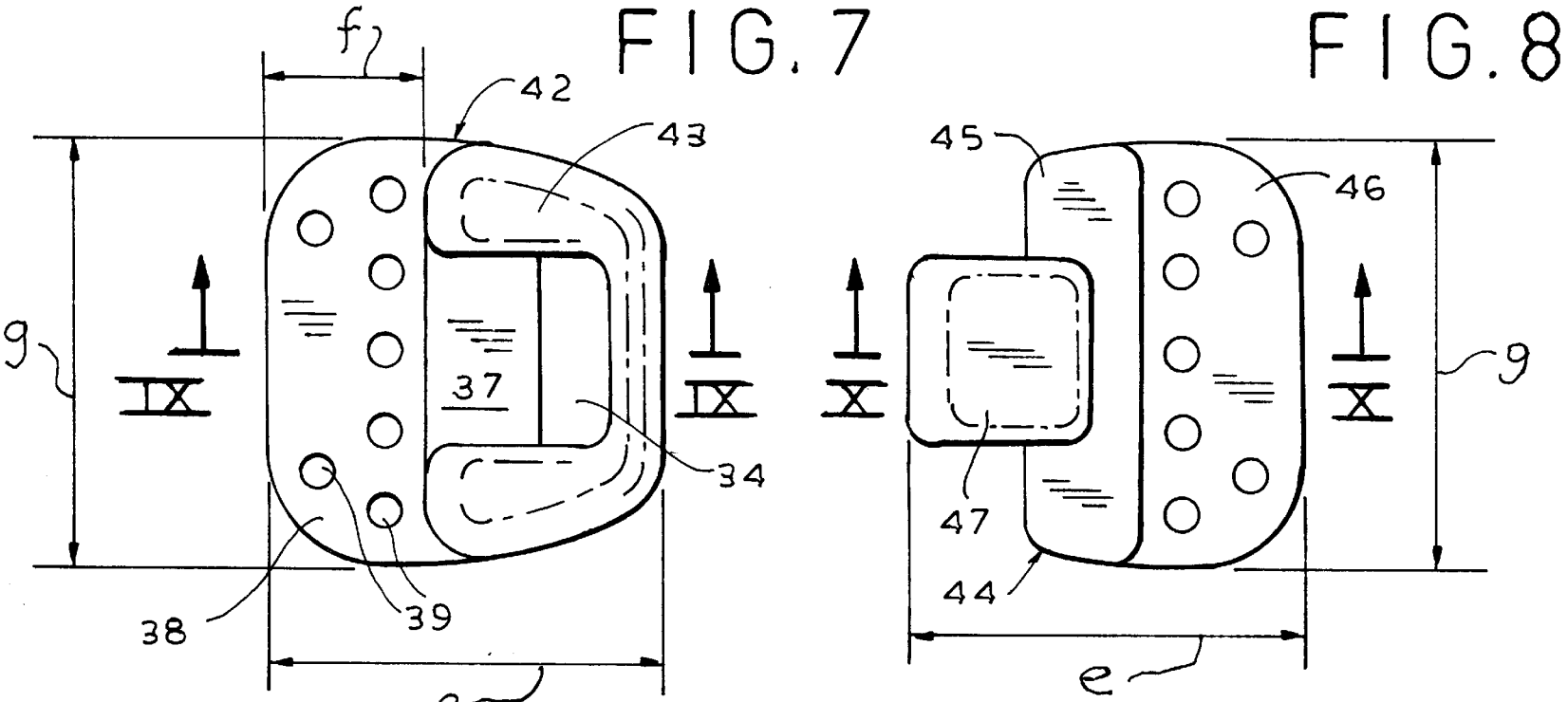
FIG. 7 is a view similar to FIG. 3 of a modified female closure member.
FIG. 8 is a front view of the corresponding male closure member.
FIG. 9 is a cross sectional view along the line IX—IX of FIG. 7.
FIG. 10 is a cross sectional view along the line X—X of FIG. 8.

This is readily apparent from FIG. 5. FIG. 6 shows the engaged position from the back. It will be apparent that the closure can be made so that opening involves a movement of one of the membranes rearwardly.

Another embodiment of the closure has been shown in FIGS. 7 through 10 from which it will be apparent that the female member 42 has a frame 43 for the eye 34 which is bevelled or rounded at its edges 35, 36. Here the ledge is seen at 37 and the sewing flange at 38. The sewing flange can be perforated at 39 to facilitate stitching through. Advantageously, the overall width e of the member 42 can be 2 to 3 times the width f of the sewing flange 38. In a practical embodiment, the width 3 can be 15 mm while the length g can be 16 mm.

Figure 12:
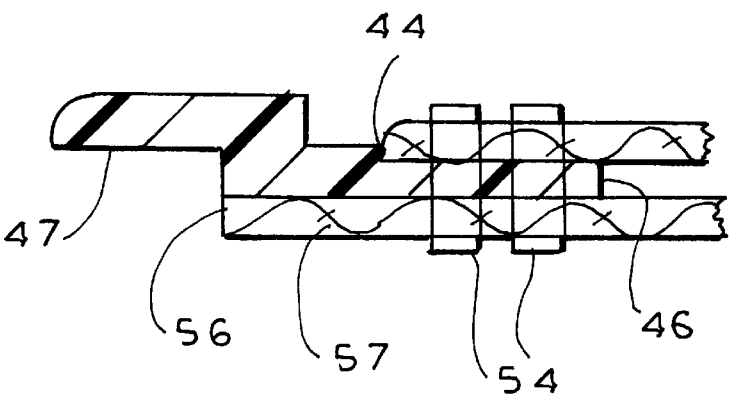
FIG. 12 is a view similar to FIG. 11 but showing the male closure.
Figure 13:
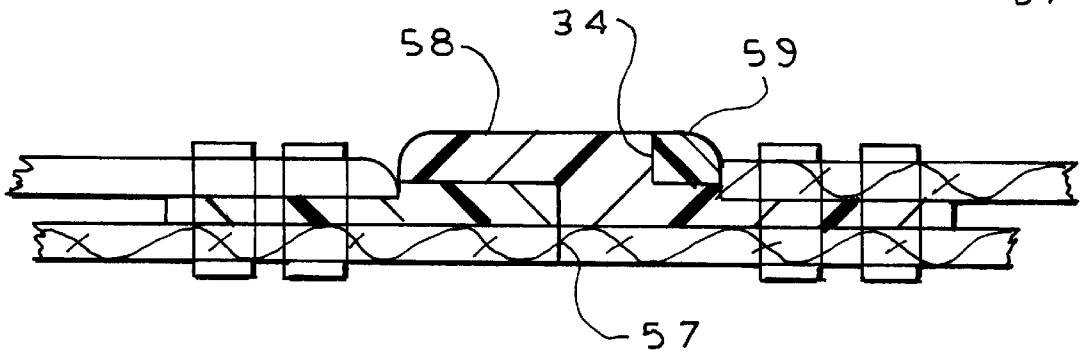
FIG. 13 is a cross sectional view showing the closure members coupled together and stitched to the respective flaps.
Figure 11:
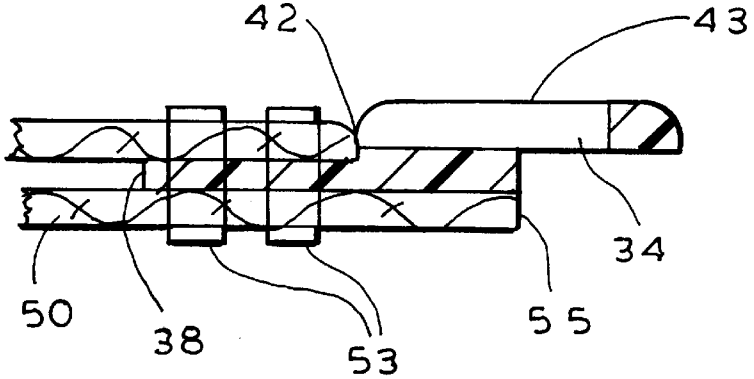
FIG. 11 is a view similar to FIG. 9 but showing the fabric tab and flap stitched to the female closure member.

The male closure member 44 has a body 45, a perforated sewing flange 46 and a tongue 47 which fits into the eye 34 with a snap fit. This closure member has the width e and the length g if described. As can be seen from FIGS. 11 and 12, when the flaps 40 and 51 are stitched to the closure members 42 and 44 through the respective sewing flanges 38 and 46, the stitching being shown at 53 and 54, when the two members are snapped together (FIG. 13) the edges 55 and 56 of the fabric flaps abut at 57 (compare FIG. 13 with FIGS. 11 and 12) and the closure is concealed from the front.

The surfaces 58 and 59 of the tongue 47 and the frame 43 are flush and coplanar. To release the closure, the members are offset angularly to pop the tongue 58 out of the eye 34. Conversely, to engage the closure member, the tongue 38 is inserted into the eye 34 from the front side of the closure member 42 and rotated until it is coplanar therewith.

What is claimed is:

1. A front closure assembly for a brassiere, comprising:

a pair of fabric flaps extending toward one another from respective cups of a brassiere at a front thereof, said flaps having juxtaposed edges; and a hidden closure interconnecting said flaps and concealed from view in a connected state of said closure, said closure comprising:

a first closure member formed with a body, a tongue projecting from said body and a sewing flange projecting from said body in a direction opposite said tongue, and a second closure member formed with a body, an eye formed on said body and dimensioned to receive said tongue, and a sewing flange projecting from said body in a direction opposite said eye, said sewing flanges being flush with one another and lying in a common plane at one side of said closure in a closed state thereof, said flaps being stitched to said sewing flanges so that said edges abut in said closed state of said closure, said tongue being received in said eye so that surfaces of said eye and said tongue are flush with one another in a common plane on another side of said closure opposite said one side.

2. The front closure assembly for a brassiere defined in claim 1 wherein said tongue engages with a snap fit in said eye.

3. The front closure assembly for a brassiere defined in claim 2 wherein said tongue and said eye are of rectangular outline.

4. The front closure assembly for a brassiere defined in claim 3 wherein said tongue and said eye are of a generally square outline.

5. The front closure assembly for a brassiere defined in claim 4 wherein said sewing flanges have approximately one-third to one-quarter of the overall thickness of the respective closure member.

6. The front closure assembly for a brassiere defined in claim 5 wherein said body of said second closure member has a portion overlapped by said eye, said tongue engaging over said portion in the closed state of said closure.

7. The front closure assembly for a brassiere defined in claim 6 wherein said sewing flanges are perforated.

8. The front closure assembly for a brassiere defined in claim 6 wherein said sewing flanges are nonperforated.

9. The front closure assembly for a brassiere defined in claim 6 wherein said sewing flanges have widths of about one-half to about one-third an overall width of the respective closure member.

10. The front closure assembly for a brassiere defined in claim 9, further comprising a respective fabric tab extending from each cup over the respective sewing flange on a side thereof opposite the respective flap and stitched thereto through the respective sewing flange.

11. The front closure assembly for a brassiere defined in claim 10 wherein each of said sewing flanges forms a step with the respective body on said other side of the closure.

12. A concealable front closure for a brassiere comprising:

a first closure member formed with a body, a tongue projecting from said body and a sewing flange projecting from said body in a direction opposite said tongue; and a second closure member formed with a body, an eye formed on said body and dimensioned to receive said tongue, and a sewing flange projecting from said body in a direction opposite said eye, said sewing flanges being flush with one another and lying in a common plane at one side of said closure in a closed state thereof, said tongue being received in said eye so that surfaces of said eye and said tongue are flush with one another in a common plane on another side of said closure opposite said one side.

13. The front closure defined in claim 12 wherein said tongue engages with a snap fit in said eye.

14. The front closure defined in claim 12 wherein said tongue and said eye are of rectangular outline, said sewing flanges having approximately one-third to one-quarter of the overall thickness of the respective closure member.

15. The front closure defined in claim 12 wherein said body of said second closure member has a portion overlapped by said eye, said tongue engaging over said portion in the closed state of said closure.

16. The front closure defined in claim 12 wherein said sewing flanges are perforated.

17. The front closure defined in claim 12 wherein said sewing flanges are nonperforated.

18. The front closure defined in claim 12 wherein said sewing flanges have widths of about one-half to about one-third an overall width of the respective closure member.

19. The front closure defined in claim 12, further comprising a respective fabric tab extending from each cup over the respective sewing flange on a side thereof opposite the respective flap and stitched thereto through the respective sewing flange.

20. A brassiere comprising:

a pair of cups each having a fabric flap extending toward the fabric flap of the other cup at a front of the brassiere, said flaps having juxtaposed edges; and a hidden closure interconnecting said flaps and concealed from view in a connected state of said closure, said closure comprising:

a first closure member formed with a body, a tongue projecting from said body and a sewing flange projecting from said body in a direction opposite said tongue, and a second closure member formed with a body, an eye formed on said body and dimensioned to receive said tongue, and a sewing flange projecting from said body in a direction opposite said eye, said sewing flanges being flush with one another and lying in a common plane at one side of said closure in a closed state thereof, said flaps being stitched to said sewing flanges so that said edges abut in said closed state of said closure, said tongue being received in said eye so that surfaces of said eye and said tongue are flush with one another in a common plane on another side of said closure opposite said one side.

* * * * *